United States Patent [19]

Bartholomäus et al.

[11] Patent Number: 4,709,619

[45] Date of Patent: Dec. 1, 1987

[54] PROPORTIONAL MAGNET

[75] Inventors: Reiner Bartholomäus, Neuendorf; Karlheinz Widmann, Lohr, both of Fed. Rep. of Germany

[73] Assignee: Mannesmann Rexroth GmbH, Lohr, Fed. Rep. of Germany

[21] Appl. No.: 931,884

[22] Filed: Nov. 18, 1986

Related U.S. Application Data

[63] Continuation of Ser. No. 631,129, Jul. 16, 1984, abandoned.

[30] Foreign Application Priority Data

Aug. 17, 1983 [DE] Fed. Rep. of Germany ..... 3329734

[51] Int. Cl.[4] ..... F01B 31/00

[52] U.S. Cl. ..... 92/130 D; 92/84; 91/453; 251/14; 251/129.03

[58] Field of Search ..... 251/129.03, 14, 63.4, 251/57, 80, 129.08; 92/84, 130 D; 91/453, 463

[56] References Cited

U.S. PATENT DOCUMENTS

| | | | |
|---|---|---|---|
| 1,230,150 | 6/1917 | Geraghty | 251/14 |
| 1,425,412 | 8/1922 | Norwood | 251/80 |
| 1,648,710 | 11/1927 | Wright | 251/14 |
| 4,176,687 | 12/1979 | Ensign | 251/80 |

*Primary Examiner*—Samuel Scott
*Assistant Examiner*—Noah Kamen
*Attorney, Agent, or Firm*—Martin LuKacher

[57] ABSTRACT

Proportional magnet having a housing in which an armature bar is mounted which is movable under the influence of an armature winding arranged in the housing, wherein a hydraulic unit serving to operate the armature bar is additionally provided.

17 Claims, 2 Drawing Figures

PROPORTIONAL MAGNET

This is a continuation of application Ser. No. 631,129, now abandoned, filed July 16, 1984.

The invention relates to a proportional magnet having a housing in which an armature bar is mounted to be movable to and fro and is movable out of a position of rest by excitation of an electric winding. The invention relates preferably to a proportional magnet of the constructional type shown in the drawings.

As is known, proportional magnets are used for adjusting in electrically proportional manner many different types of hydraulic valves. For uses where the electrical actuating system may fail because of environmental conditions, or where in unfavourable circumstances a cable may suffer fracture or disruptive breakdown, proportional magnets with emergency manual operating systems are already used. As its name implies, an emergency manual operating system of this kind is operated by hand in the event of an emergency. However, this requires that the emergency manual operating system should be satisfactorily accessible i.e. it must be possible to site the valves in suitable advantageous locations. In cases where this is not possible, for example if the valves are situated on a jib (e.g. in a crane) or are situated in other inaccessible corners of a compact machine (e.g. a machine used in mining work), and if moreover mechanical operation of the emergency manual operating system is not possible, the known proportional magnets cannot be used or can be used only with great operational or safety risks.

Proportional magnets are used frequently in conjunction with proportional valves used for flow path control. Such proportional valves comprise essentially a pilot control valve with the proportional magnet, and a main valve with the main piston and a centring spring. The proportional magnet described below is to be usable more particularly for such proportional valves.

The invention has as its object to obviate the disadvantages of the state of the art. More particularly the invention provides a proportional magnet which can be operated still in a reliable and simple way in the event of failure of the electrical actuating facility even when fitted in an unfavourable situation.

To achieve this object, in a proportional magnet of the kind mentioned initially the invention proposes that hydraulic operation of the proportional magnet is effected. According to a preferred example of embodiment of the invention, hydraulic operation is effected by action on the armature bar. According to a further preferred example of embodiment of the invention, a hydraulically operated piston transmits the operating force to the armature bar by spring means.

Further preferred features of the invention are shown more particularly in the claims.

BRIEF DESCRIPTION OF THE DRAWINGS

Further advantages, aims and details of the invention are apparent more particularly from the claims, the drawings and the description given below of examples of embodiment with the help of the drawings. In the drawings:

DESCRIPTION OF THE PREFERRED EMBODIMENTS

Figure 1:
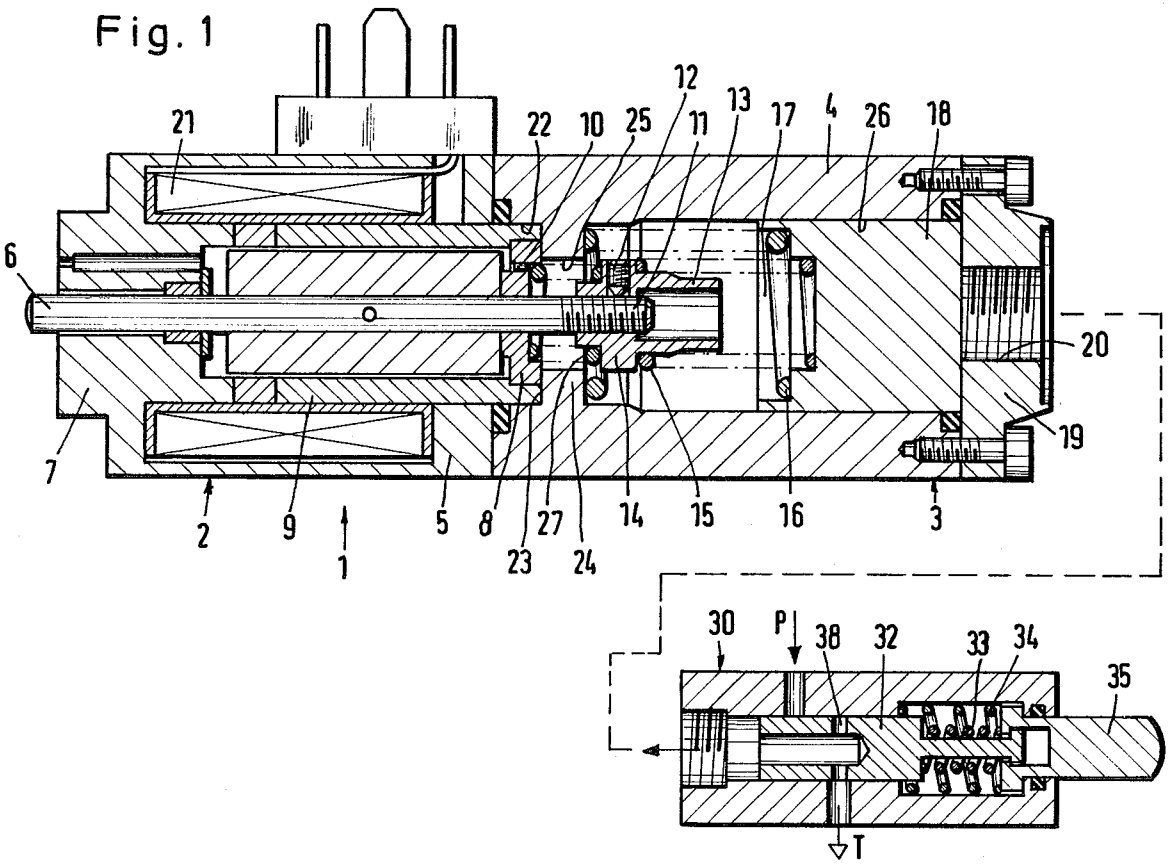
FIG. 1 shows a proportional magnet with redundant actuating system.

FIG. 1 shows an electro-hydraulic redundant proportional magnet 1, i.e. a proportional magnet 2 which in addition to the usual electric actuating system represented by a winding 21 also comprises a hydraulic actuating system in the form of a hydraulic actuating element 3.

As is known, proportional magnets are electromagnets the power of which varies proportionally to an applied electrical input signal. These known proportional magnets, as also the electro-hydraulic redundant proportional magnets 1 in FIG. 1 and 101 in FIG. 2 which will also be described here, can be used for example in proportional valves which are not operated in an electrical control system. They can be used for the following return systems: hydraulic return (hydraulic pressure regulating systems); mechanical-hydraulic return (return by means of compression springs, flexural springs etc.); follow-up piston systems; hydropotentiometric return systems.

The electro-hydraulic redundant proportional magnet 1 shown in FIG. 1 is situated in its non-actuated position i.e. its so-called position of rest. The winding 21 is not energised nor is the hydraulic actuating element 3 operated. The proportional magnet 2 comprises in the usual way a proportional magnet housing 5 which surrounds the already-mentioned winding 21 and is closed at one end by a cover part 7 which itself is connectable to an apparatus to be actuated, for example a valve not shown here. The armature bar 6 supporting an armature is mounted in the cover part 7 by means of a bearing not referenced in detail. At the opposite end the armature bar 6 is mounted in a guide part 8 which comprises a central bore. The guide part is held by a sleeve part 9 which is secured on the housing 5 preferably, as illustrated, by beading the sleeve part 9 about the guide part 8. Radially offset relatively to the central bore receiving the armature bar 6 at least one further bore 10 is arranged in the guide part 8. As far as the description of the proportional magnet 2 so far goes, it is a magnet of per se known construction. In the illustrated position of rest the armature bar 6 is situated in the position shown in FIG. 1. When an actuating signal is applied to the winding 21, the armature bar is moved by magnetic forces towards the left in FIG. 1, to operate a flow path control proportional valve screwed for example to the cover 7. After the actuating signal on the winding 21 has been discontinued, the armature bar 6 returns to its position of rest, this being brought about by suitable return means (not shown). It should be pointed out also that because of the bore 10 the pressure chamber which is bounded at one side by a control piston 18 and at the other side by the guide part 8 and which is provided in the interior of an actuating housing 4 is in the example of embodiment according to FIG. 1 also at the same pressure as the interior of the proportional magnet 2.

When in the proportional magnet 2 as described hitherto a failure occurs in the electronics producing the actuating signal for the winding 21, it is no longer possible to move the armature bar 6 from the illustrated position of rest into its operating position. For this reason emergency manual operating systems are already known which allow shifting of the armature bar 6 despite failure of the electronics. It is a disadvantage in such cases that such emergency manual operating systems are often inaccessible, as already mentioned initially.

The hydraulic actuating element 3 is arranged on the proportional magnet 2 according to the present invention. This element has an actuating housing 4 as already mentioned, of approximately the same diameter as the housing 5, being secured to the housing 5 in axial alignment therewith by means not shown in detail. At its end directed towards the proportional magnet 2 the actuating housing 4 comprises a central recess 22 which, with interposition of a sealing element not specified, surrounds the portion of the sleeve part 9 which projects out of the proportional housing 5 and is beaded about the guide part 8.

An extension part 11 is screwed to the armature bar 6 and supports a spring mounting part 14 which is secured on the extension part 11 by means of a screw 12. Formed integrally with the spring mounting part 14 is a spring guide part 13 which comprises a central bore, to allow access to a tool-receiving slot of the extension part 11. Preferably the extension part 11 can be made in one piece with the armature bar 6.

The central recess 22, already mentioned, of the actuating housing 4 forms an annular supporting surface 23 for the ends of the sleeve 9 and of the guide part 8. The annular supporting surface 23 is formed by a collar 24 which defines a bore 25 with a somewhat smaller diameter externally than the outer diameter of the central recess 22. Oppositely from the annular supporting surface 23 the collar 24 defines a further supporting surface for a return spring 16. The bore 26 which adjoins the bore 25 has again a larger diameter than the bore 25, in fact approximately a diameter like that of the central recess 22. The outer diameter of the return spring 16 corresponds approximately to the diameter of the bore 26.

Arranged slidably within the bore 26 is the control piston 18 which has already been mentioned briefly and which forms a supporting surface for the return spring 16. In the position of rest of the control piston 26 the return spring 16 presses this piston against a cover 19 which closes the actuating housing 4 and which is provided centrally with a pressure connection 20.

Concentrically with the return spring 16 there is arranged a control spring 15 which bears at one end on the spring mounting part 14 and at the other end on the control piston 26.

The spring mounting part 14 forms at its side directed towards the proportional magnet housing 5 a supporting surface for one end of a spring 27 whose other end bears on a supporting surface formed by a recess in the guide part 8.

The strengths of the springs 15 and 27 are so chosen that in the position of rest shown in FIG. 1 the spring mounting part 14 is held by the force of the spring 27 in the illustrated position, i.e. the force of the spring 15 is chosen to be just such as to result in a state of equilibrium existing with the spring 27 in the position of rest.

Hydraulic pressure can be applied at the already mentioned pressure connection 20, for example by means of a hydraulic pilot control device 30 which is shown diagrammatically in the lower portion of FIG. 1. Such a hydraulic pilot con device 30 allows precise adjusting of the pressure P coming from a pump, T designating the connection with the tank. A manually actuatable plunger 35 serves to displace a control piston 32 by means of a control spring 33 in opposition to the force of a restoring spring 34, so that a bore 38 is connectable to a greater or less extent with the inlet at which the pump pressure P is present.

The use of the hydraulic pilot control device 30 makes it possible to achieve virtually proportional displacement for the armature bar 6.

The redundant electro-hydraulic proportional magnet 1 shown in FIG. 1 can be used more particularly only for pressure control systems. It is characteristic of pressure control systems that the interior space of the proportional magnet is connected with the tank; thus the spring chamber 17 which is formed by the actuating housing 4 and which contains the springs 15 and 16 is also connected to the tank, in other words is not acted upon by pressure.

If for example in the case of the proportional magnet 1 shown in FIG. 1 the electronics fail, it is still possible for a valve which is operated normally by the proportional magnet 2, and which drives for example a cylinder or motor, to continue to be operated at least in one direction, namely because of operation of the hydraulic actuating element 3. Such operation is effected in that the plunger 35 is manually operated and causes a specific quantity of oil under pressure to be fed to the pressure connection 20.

As soon as through the agency of the pressure connection 20 the control piston 18 is loaded in opposition to the return spring 16, the control spring 15 is also preloaded. Since the control spring 15 is so dimensioned as to its length that in the state illustrated it exerts no force on the proportional magnet 2, the manner of operation of the proportional magnet is not impaired in the case of electrical actuation. However, if the electrical actuating system fails, the control piston 18 can be actuated via the pressure connection 20. In accordance with the strength of the return spring 16 and also the control pressure present at the pressure connection 20 the control piston 18 will move proportionally to the pressure present, and preloads the control spring 15 proportionally. At maximum control pressure the control spring 15 is so considerably preloaded that it provides the same force as the proportional magnet 2 if the latter were electrically actuated. Of course this pressure-proportional actuating system can also be modified to form a straightforward type of shifting actuating system, but in that case it would simply be a question of a hydraulic expedient.

If, for example for adjustment of a pilot control piston of a pilot control valve which itself is used for operating a main valve, two proportional magnets 2 of the kind shown in FIG. 1 are used operating in opposition to one another, it is of course also possible according to the invention also to construct an actuating element 3 at the proportional magnet not shown but arranged diametrally opposite the proportional magnet 2 in the manner shown in FIG. 1, so that the result would be a valve with completely redundant actuation facilities in all directions of movement.

Figure 2:
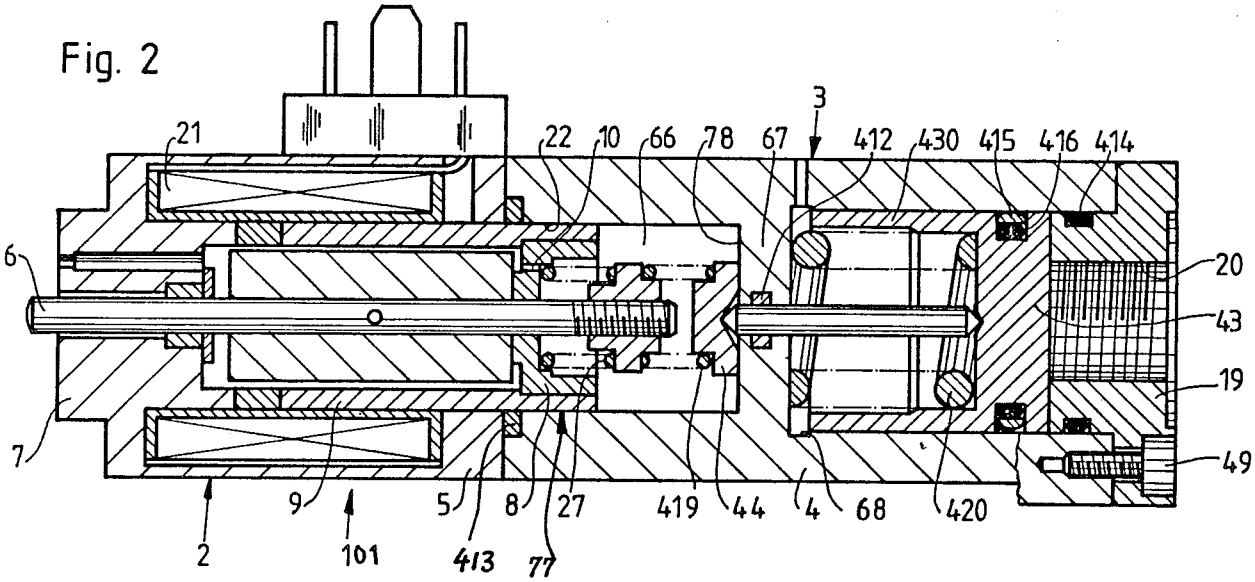
FIG. 2 shows a further example of embodiment of a proportional magnet with redundant actuating system.

FIG. 2 shows a further example of embodiment of an electrohydraulic redundant proportional magnet 101, and—whereever possible—like reference numerals as in FIG. 1 are used for like parts.

The electro-hydraulic redundant proportional magnet 101 shown in FIG. 2 is illustrated in its position of rest. The redundant proportional magnet 101 comprises essentially two parts, namely the proportional magnet 2 and the hydraulic actuating element 3, which is secured in a manner not shown in detail on the proportional magnet 2. The armature bar 6 of the proportional magnet 2 is mounted in a manner not shown in detail on the one hand in the cover part 7 and on the other hand in an end part 77 of the proportional magnet 2, which end part is diametrical in relation to the said cover part. The actuating housing 4 of the actuating element 3 surrounds the end part 77 and abuts flush against the proportional magnet 2, and a sealing element 413 is provided between the proportional magnet 2 and the actuating element 3.

The actuating housing 4 is of substantially tubular construction, and a transverse wall 67 projecting inwards defines a spring chamber 66 and a spring chamber 68.

The spring chamber 66 is bounded by this outer surface of the end part 77, a supporting surface 78 formed by the transverse wall 67, and the circular-cylindrical shape of the inner surface of the actuating housing 4. Within the spring chamber 66 there is arranged a control spring 419, and this control spring is situated between a spring mounting part 44 and a spring mounting part 45. The spring mounting part 45 is secured to the armature bar 6 projecting into the spring chamber 66. In its position of rest the spring mounting part 44 abuts on the supporting surface 78 owing to the force of the control spring 419. The spring mounting part 44 comprises centrally on its side facing towards the supporting surface 78 a conical bearing surface against which one tip of a coupling plunger 46 comes to abut in the manner of centre bearings. The coupling plunger 46 extends through a central aperture which is provided in the transverse wall 67 and in which a sealing element 412 seals against fluid flow between the spring chamber 66 and the spring chamber 68. With its end directed away from the proportional magnet 2 the coupling plunger 46 is mounted in the manner illustrated in a conical recess of the control piston 43, again as in a centre bearing arrangement. The control piston 43 has a tubular extension 430 inside which a return spring 420 is arranged and which projects towards the transverse wall 67. The return spring 420 abuts on the one hand on the abutment surface 167 formed by the transverse wall 67, and on the other hand the other end of the return spring 420 abuts on the inner surface 431 of the control piston 43. In an annular groove of the control piston 43 there are arranged a sealing element 415 of elastic material and an O-ring 416, to provide a fluid-tight seal for the control piston 43. The control piston 43 can be subjected to fluid pressure from the right through a pressure connection bore 20, to be moved out of its position of rest shown in FIG. 2 into its operating position. Cover 19 is secured by screws 49 on the actuating housing 4 and closes the piston chamber 68 in pressure-tight manner with the use of a sealing element 414.

The electrohydraulic redundant proportional magnet 101 shown in FIG. 2 is usable preferably for mechanical return systems, i.e. return systems wherein the interior space of the proportional magnet 2 is acted upon by the pressure of the hydraulic device to be actuated. Because of the use of a plunger 46 the magnet interior is separated as regards pressure from the spring chamber 68 of the return spring 420 by the sealing element 412. The diameter of the plunger 46 is preferably made as small as possible in the region of the sealing element 412, so that the reaction of the proportional magnet internal pressure on the pressure necessary for control has only a slight effect with hydraulic actuation.

Similarly to what is the case in the example of embodiment according to FIG. 1 it is also possible in the example of embodiment shown in FIG. 2 to use a hydraulic pilot control device 30 of the kind shown in FIG. 1, which will be connected to the pressure connection bore 20.

As mentioned, FIG. 2 shows the position of rest of the electro-hydraulic redundant proportional magnet 101. The return spring 420 holds the control piston 43 in abutment against the inner side of the cover 19. The control spring 419 bears on the spring mounting part 44 which abuts on the supporting surface 78 and also abuts on the spring mounting part 45, without moving the armature bar 6 from the position of rest into an operating position offset to the left relatively to the position shown in FIG. 2.

As long as the electronics of the proportional magnet 2 operate normally, the armature bar 6 can be moved to the left from the position shown in FIG. 2 in accordance with the applied electrical signal without the control spring 419 exerting any considerable force on the armature bar 6.

But if for any reason the electronics for the electrical actuation of the proportional magnet 2 fail, according to the invention the electrical actuating system is replaced by a hydraulic actuating system, applying pressure via the pressure connection bore 20 to the control piston 43 so that the latter moves to the left with compression of the return spring 420. When this happens, the plunger 46 is carried along also, and itself displaces the spring mounting part 44 and through the agency of the control spring 419 the spring mounting part 45 also, and the latter displaces the armature bar 6 into the desired operating position. As a result it is possible to adjust the element operated by the end of the armature bar 6 shown on the left in FIG. 2, such as for example the pilot control piston of a pilot control valve or of a valve itself.

As regards other details, as in the example of embodiment according to FIG. 1 the control spring 419 is so dimensioned as to its length (force) that in the illustrated state it exerts no force on the armature bar 6 of the proportional magnet 2. This ensures that the working of the proportional magnet 2 is not prejudiced when electrical actuation is used. When hydraulic actuation is used in the event of failure of the electrical actuating system, the control piston 43 is moved proportionally to the applied pressure in accordance with the force of the return spring 420 and the control pressure applied to the said piston, so that the control spring 419 also is proportionally preloaded. At the maximum control pressure applied to the control piston 43 the control spring 419 is preloaded to such an extent that it produces the same force as the proportional magnet 2 would if electrically actuated.

Just as in the case of the example of embodiment according to FIG. 1, this hydraulic pressure-proportional actuating system can be replaced by an actuating system having a simple hydraulically shifting action, so that for all practical purposes what would then result would be a hydraulic emergency operating system.

It is advantageous and possibly necessary to have such a hydraulically proportional actuating system, or even such an emergency operating system, in cases where an open dredger control system is to be provided.

Since the hydraulically produced forces are to be reduced to the level of the electromagnetically produced forces, arranging the control piston 43 directly on the armature bar 6 does not come into question.

To provide a hydraulically proportional actuating system in the case of the redundant electro-hydraulic proportional magnets 1 and 101 shown in FIGS. 1 and 2 it is necessary to use a pilot control device 30 of the type shown in FIG. 1 which is variable as regards its delivery pressure. A simple hydraulic shifting device would allow only hydraulic emergency operation.

The measures proposed by the invention may also be used in a switch magnet.

We claim:

1. In proportional magnet apparatus having a magnet unit with a housing in which an armature bar is mounted which is movable from a rest position under the influence of a magnetic field from an armature winding arranged in the housing and having means for providing a force biasing said armature bar to said rest position, the improvement comprising a hydraulic actuator unit with a housing having a control piston therein, means coupling the armature bar to said piston for moving said armature bar when said hydraulic unit is actuated in a manner equivalent to that of said magnetic field, and means for manually controlling the application of hydraulic pressure to said hydraulic unit for actuating said piston, wherein said coupling means contains a spring arrangement, said control piston is mechanically connected via said spring arrangement to said bar, said spring arrangement providing means for translating the hydraulically produced forces on said piston into forces which are the same as applied to said armature bar by said proportional magnet armature winding, and wherein said coupling means spring arrangement comprises a return spring bearing on said control piston and a control spring opposing the force of said biasing means by way of means enabling said control spring to bear on said armature bar, said control spring being preloaded said preload being less than a preload of said biasing means so that said control spring does not move said armature bar in said rest position, said return spring and said control spring bear on the side of said control piston which faces towards the interior of said hydraulic unit, and said return spring bears on said hydraulic housing.

2. The invention according to claim 1, further comprising a guide part for said armature bar, said guide part being secured on the housing, said biase means comprising a spring which bears on said magnet unit housing via said guide part.

3. The invention according to claim 2 wherein all of the springs are helical springs.

4. The invention according to claim 2 wherein said guide part has a bore providing a connection between the interior of the magnet unit housing and the interior of the hydraulic unit housing.

5. The invention according to claim 1 wherein said hydraulic unit is a separate unit, and means for securing said hydraulic unit and magnet unit together.

6. In proportional magnet apparatus having a magnet unit with a housing in which an armature bar is mounted which is movable from a rest position under the influence of a magnetic field from an armature winding arranged in the housing and having means for providing a force biasing said armature bar to said rest position, the improvement comprising a hydraulic actuator unit with a housing having a control piston therein, means coupling the armature bar to said piston for moving said armature bar when said hydraulic unit is actuated in a manner equivalent to that of said magnetic field, and means for manually controlling the application of hydraulic pressure to said hydraulic unit for actuating said piston, wherein said coupling means contains a spring arrangement, and said control piston is mechanically connected via said spring arrangement to said bar, said spring arrangement providing means for translating the hydraulically produced forces on said piston into forces which are the same as applied to said armature bar by said porportional magnet armature winding, and wherein said coupling means spring arrangement comprises a return spring bearing on said control piston and a control spring opposing the force of said biasing means by way of means enabling said control spring to bear on said armature bar, and said control spring being preloaded, said preload being less than a preload of said biasing means so that said control spring does not move said armature bar in said rest position, wherein said units define a first spring chamber and a second chamber which is sealed off from the first spring chamber, the first spring chamber being at the same pressure as the interior of the magnet unit housing, said control piston and return spring being disposed in said second chamber, said means enabling said control spring to bear upon said armature bar including a plunger extending between said chambers and bearing on said control piston, said control spring being arranged in said first spring chamber and said control spring bearing on said plunger.

7. The invention according to claim 6 further comprising a spring mounting part in said first chamber which in its position of rest abuts on a supporting surface defining an end of said first chamber, wherein said control spring bears on said plunger via said spring mounting part.

8. The invention according to claim 7 wherein said spring mounting part defines a substantially conically shaped recess disposed centrally on one end of said spring mounting part, said plunger being disposed at one of its ends in said recess, whilst the other end of said plunger is situated in a recess centrally of the control piston.

9. The invention according to claim 7 wherein the first spring chamber and the second spring chamber are separated by a transverse wall, said transverse wall providing the supporting surface for the mounting part and also a supporting surface for the return spring.

10. The invention according to claim 9 wherein the control piston has a tubular extension within which the return spring is arranged.

11. The invention according to claim 9 wherein the control piston is sealed relatively to the inner wall of the hydraulic unit housing.

12. The invention according to claim 9 wherein said hydraulic unit housing is provided with a cover at the end thereof opposite to said magnet unit, said cover having a pressure connection bore for communicating hydraulic pressure from said controlling means for actuating said piston.

13. The invention according to claim 6 wherein the plunger is arranged in alignment with the armature bar.

14. The invention according to claim 1 wherein said hydraulic unit and magnet unit have a common central axis, means in said hydraulic unit mounting said control piston in said hydraulic unit for displacement along said common central axis when said hydraulic pressure is applied.

15. The invention according to claims 1 or 6 wherein said hydraulic unit housing has a cover which closes said housing, and a pressure connection in said cover for pressurized hydraulic fluid from said controlling means.

16. The invention according to claims 1 or 6 wherein said controlling means is a hydraulic pilot control means remote from said hydraulic unit.

17. The invention according to claim 16 wherein the hydraulic pilot control means comprises a control piston, a control spring, a restoring spring and a plunger.

* * * * *